United States Patent [19]

Ikenoue et al.

[11] 3,960,566

[45] June 1, 1976

[54] METHOD FOR DRY STABILIZATION OF SILVER HALIDE PHOTOGRAPHIC MATERIAL

[75] Inventors: Shinpei Ikenoue; Takao Masuda, both of Asaka, Japan

[73] Assignee: Fuji Photo Film Co., Ltd., Minami-ashigara, Japan

[22] Filed: Dec. 6, 1973

[21] Appl. No.: 422,387

[30] Foreign Application Priority Data

Dec. 8, 1972 Japan ..... 47-123212

[52] U.S. Cl. ..... 96/61 R; 96/119 PQ

[51] Int. Cl.[2] ..... G03C 5/38

[58] Field of Search ..... 96/61 R, 114.1, 109, 96/119 PQ

[56] References Cited

UNITED STATES PATENTS

| | | | |
|---|---|---|---|
| 3,248,219 | 4/1966 | Jacobs | 96/61 R |
| 3,594,172 | 7/1971 | Sincius et al. | 96/108 R |
| 3,821,001 | 6/1974 | Weber | 96/114.1 |

FOREIGN PATENTS OR APPLICATIONS

| | | | |
|---|---|---|---|
| 1,160,956 | 8/1969 | United Kingdom | 96/108 R |

*Primary Examiner*—Mary F. Kelley

*Attorney, Agent, or Firm*—Sughrue, Rothwell, Mion, Zinn & Macpeak

[57] ABSTRACT

Dry stabilization of a silver halide photographic material is obtained by heating the silver halide photographic material to a temperature of at least 80°C. in the presence of an organic iodine-containing compound, such as monoiodoacetic acid, isopropyl iodide, or iodocyclohexane. Preferably, the heating is carried out after the formation of an image on the material. The organic iodine-containing compound can be added to the silver halide emulsion in the molten state during the preparation of the emulsion. This method is especially effective when applied to silver halide photographic materials which contain silver halide grains at least 50 mol% of which consists of silver bromide.

12 Claims, No Drawings

METHOD FOR DRY STABILIZATION OF SILVER HALIDE PHOTOGRAPHIC MATERIAL

BACKGROUND OF THE INVENTION

1. Field of the Invention

This invention relates to a method for stabilizing a silver halide photographic material in the dry state.

2. Description of the Prior Art

Silver halide photographic materials in general are fixed by dissolving the silver halide using a fixation bath after the formation of an image, and then removing the dissolved silver complex ion by washing with water.

A method for stabilizing a silver halide photographic material intended for shortening the processing time is known. The method comprises converting the silver halide to a silver complex compound devoid of photosensitivity after the formation of an image, without performing a washing with water. Specifically, this method is performed by dipping a silver halide photographic material having an image formed thereon in an aqueous solution containing sodium thiosulfate, magnesium thiosulfate or thiourea as a stabilizer, and then drying the material (see *Photographic Chemistry*, Vol. 1, page 158, ζ149, Fountain Press, 1958). However, since this processing is a wet processing by which the photographic material is passed through an aqueous processing bath the photographic material must be dried in the final step. The presence of the drying step is a great defect from the viewpoint of shortening the treating time. Furthermore, the use of a treating liquid causes contamination of things around it or requires control with respect to the preparation or exchanging of the processing liquid. Accordingly, it would be very significant to provide a new dry stabilizing method.

Methods are known by which an image is formed on a silver halide photographic material using a dry treatment such as print out, thermo-development or photodevelopment in an attempt to remove the various defects of wet processing. However, in these methods also, the recorded images cannot be preserved unless they are stabilized, that is to say, unless the discoloration of the non-image area by light is prevented when the processed photographic material is allowed to stand in a bright room. In other words, a method of dry stabilization is required.

One of such dry stabilization methods is disclosed in U.S. Pat. Nos. 3,447,926 and 3,418,122. This method is one in which dry stabilization is carried out imagewise, and quite differs from the dry stabilization method in accordance with this invention. If stabilization is only carried out imagewise, the density of the image area changes progressively when the recorded photographic material stands in a bright place.

In contrast, the dry stabilization method of the present invention permits stabilization of both the image area and the non-image area simultaneously, and can lead to an inhibition of the light discoloration of the entire processed photographic material. Accordingly, the dry stabilization method of this invenion is complete in comparison with the dry stabilization described in the above-described U.S. Patents, and brings about the same effect in the dry state as the conventional wet stabilization method disclosed in the above-cited Photographic Chemistry.

Another conventional dry stabilization method is disclosed in U.S. Pat. NO. 3,615,510. This method comprises stabilizing the silver halide using a compound selected from the group consisting of organic sulfonium halides, organic sulfoxonium halides, organic ammonium halides, organic phosphonium halides, organic bronium halides, organic siliconium halides, and mixtures of these materials. According to the disclosure of this U.S. Patent, these compounds are complex salt-forming agents for the silver halide, and in order to make it possible to stabilize the silver halide by dry processing, an image stabilizing layer must be provided by adding such a compound to a low-melting non-aqueous solvent and a polymerizable binder in which the melted solvent can be diffused, and coating the mixture on the silver halide emulsion layer. When the photographic material so produced is heated, the solvent melts and the complex salt forming agent diffuses into the emulsion layer and reacts with the silver halide to thereby stabilize the photographic material.

In order to achieve this object, the manufacturing of the photographic material requires an additional step of providing the image-stabilizing layer adjacent the photographic layer. Furthermore, in order to diffuse the complex salt-forming agent into the emulsion layer entirely and stabilize the emulsion layer uniformly, it is necessary to add the complex salt-forming agent directly to the emulsion and thus to include a large amount of the complex salt forming agent in the image-stabilizing layer as compared with the amount required for stabilizing the emulsion layer. Alternatively, the complex salt-forming agent is coated on a developing web, and the photographic material is heated while in contact with it. These methods, however, require a complicated operating procedure.

Another procedure can be used in which an aqueous solution of a stabilizer is added to the emulsion at room temperature or at a lower temperature to include the stabilizer in the emulsion layer. However, if the stabilizer is included in the emulsion in an amount sufficient for stabilization, it greatly affects the photographic properties of the material.

The three procedures of using the stabilizer are undesirable for various reasons such as the increased number of manufacturing steps, the troublesome operations, and the great influence on the photographic properties. A preferred procedure which lends itself to the easiest operation involves adding a stabilizer to an emulsion in the molten state, that is, an emulsion heated to a temperature higher than room temperature, for example, to 40°C. to disperse the stabilizer sufficiently uniformly in the emulsion, and then coating the dispersion on the support.

An object of this invention is to provide a method of dry stabilization of a silver halide photographic material.

Another object of this invention is to provide a method for dry stabilization of a silver halide photographic material using a stabilizer that can be directly added to an emulsion in the molten state.

Still another object of this invention is to provide a method for the dry stabilization of a silver halide photographic material using a stabilizer which does not require the use of a stabilization promotor such as a low-melting non-aqueous solvent.

SUMMARY OF THE INVENTION

These objects can be achieved by using a stabilizer which does not greatly affect the photographic properties of a photographic material such as sensitivity or gradation even upon contact with silver halides. More specifically, these objects can be achieved by using as a stabilizer, a compound which forms with difficulty a complex salt by reaction with silver halide.

According to this invention, there is provided a method for stabilizing a silver halide photographic material in the dry state, which comprises heating the silver halide photographic material to a temperature of at least 80°C. in the presence of an organic compound having an iodine atom connected to the carbon atom and being capable of releasing an iodine atom or ion when heated to a temperature of at least 80°C.

DETAILED DESCRIPTION OF THE INVENTION

Generally, silver halide photographic materials are unstable to light, and when allowed to stand in a bright place after processing, they are colored especially at the non-image area. Surprisingly, however, it has been found that a silver halide photographic material can be stabilized to light merely by heating it to a temperature of at least 80°C. in the presence of a specific organic compound having an iodine atom connected to a carbon atom and being capable of releasing an iodine atom or ion when heated to a temperature of at least 80°C. When the photographic material so stabilized is allowed to stand in a bright place after processing, scarcely any coloration occurs. Thus, the fixation or stabilization step absolutely required in the processing of silver halide photographic materials can be completely replaced by the above-described dry processing technique.

The detailed mechanism on the effect of stabilization to light of silver halide thus obtained by heating in the presence of a specific organic compound is not at present completely understood. However, in view of the fact that qualitative X-ray diffraction analysis shows that for a silver halide, for example silver bromide, which has been heated in the presence of the dry stabilizer in accordance with this invention, such as monoiodoacetic acid, a peak shift to a lower angle side results. From this it is presumed that the iodine atom or ion released from the monoiodoacetic acid has reacted with the silver bromide.

Preferred dry stabilizers which can be used in this invention are expressed by the following general formula

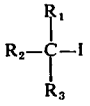

(I)

wherein each of $R_1$, $R_2$ and $R_3$ is a hydrogen atom, alkyl group, a substituted alkyl group, alkenyl group, a substituted alkenyl group, an alkynyl group, a substituted alkynyl group, an aryl group, a substituted aryl group, a halogen atom (F, Cl, Br, I), an acylalkoxy group, a carboxy group, a nitro group, an amino group, a substituted amino group, a formyl group, an oxo group, cyano group, or a mercapto group, the substituted alkyl group, substituted alkenyl group, substituted alkynyl group and substituted aryl group having a substituent such as a halogen atom, a nitro group, amino group, a formyl group, carbonyl group, a cyano group, a mercapto group, an acyl group or an alkoxy group;

or

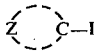

(II)

wherein Z is C, O, N, S or Se and forms a 5-membered or 6-membered ring which may optionally have a substituent such as an alkyl group, an alkenyl group, an alkynyl group, an aryl group, a halogen atom (F, Cl, Br, I), an acyl group, an alkoxy group, an aralkyl group, a carboxy group, a nitro group, a substituted amino group, an amino group, a formyl group, a carbonyl group, a cyano group or an oxo group. Suitable examples of the above-described groups are alkyl groups such as a methyl group, an ethyl group, a butyl groups, an iodo propyl group, etc., of alkenyl groups such as an allyl group, and aryl groups such as a phenyl group, a naphtyl group, a tolyl group, etc. Suitable examples of 5 and 6-membered rings formed by are a benzene ring, a pyridine ring, a naphthalene ring, a furan ring, a thiophen ring, a thiazole ring, etc.

Examples of the effective dry stabilizers which can be used in this invention are iodine-containing paraffinic hydrocarbons such as isopropyl iodide, iodine-containing olefinic hydrocarbons such as iodoethylene, iodine-containing acetylenic hydrocarbons such as iodoacetylene, aromatic hydrocarbons such as iodotoluene, and heterocyclic hydrocarbons such as iodopyridine. Further examples include iodine-containing alcohols such as iodoethanol, iodine-containing phenols such as iodophenol, iodine-containing ethers such as iodoethylphenyl ether, iodine-containing amines such as iodoethyl amine, iodine-containing ketones such as iodoacetone, iodine-containing aldehydes such as iodoacetaldehyde, iodine-containing carboxylic acids such as iodoacetic acid, or the anhydrides, halides or esters thereof, iodine-containing amides such as iodoacetamide, iodine-containing sulfonic acids such as iodobutanesulfonic acid, iodine-containing nitriles such as iodobutyronitrile, and iodine-containing nitriles such as iodonitrobenzene. Compounds of the above-described general formulas (I) and (II) which are preferred are those compounds in which the carbon atom adjacent the carbon atom containing the iodine atom is an oxo group (=O) containing carbon atom such as carboxy group, a formyl group etc.

Specific examples of preferred dry stabilizers which can be used in this invention are:

ethyl iodide, n-butyl iodide, iodomethane, iodoform, tetraiodomethane, iodoacetic acid, 1,3-iodoacetone, α-iodoacetophenone, 1,4-iodobutane, 1,2-iodoethane, iodofumaric acid, iodomalonic acid, 4,6-iodo-m-phenylene diamine, 1,3-iodopropane, 2,3-iodopropanol, 5,6-iodoquinoline, α,α′-iodo-p-xylene, triiodoacetic acid, 3,4,5-triiodoaniline, 1,1,1-triiodoethane, tetraiodobenzoquinone, tetraiodoethylene, tetraiodopyrrole, iodoacetamide, 4-iodobiphenyl, 1-iodo-2-butene, 2-iodobutyric acid, 2-iodocrotonic acid, 3-iodocrotonic acid, iodocyclohexane, 2-iodocyclohexanol, 2-iodoethanol, 2-iodoethylamine, iodoethylene 2-iodoethylphenyl ether, 2-iodofuran, iodogorgoic acid, 2-iodo-6-nitro-1-naphthol, 4-iodo-6-nitro-1-naphthol, m-iodophenetole, o-iodophenotole, o-iodophenol, m-iodopenol, 2-iodo-3-phenylacrylic acid, 3-(m-iodophenyl) acrylic acid, 1-iodo-3-methylbutane, 2-iodo-2-methylbutane, 2-iodo-3-methylbutyric acid, iodomethyl methyl ether, tert.-butyl iodide, 2-iodo-2-methylpropionic acid, 4-iodo-1-naphthylamine, 8-iodo- 1-naphthylamine, 1-iodo-2-naphthylamine, 4-iodo-2-nitrobenzaldehyde, 4-iodo-m-phenylene diamine, m-iodophenyl hydrazine, 3-iodophenylphenyl ether, 3-iodo-3-phenylpropionic acid, 3-iodo-1-propanol, iodopropiolic acid, 2-iodopropionic acid, 4-iodopyridine, 21iodoquinoline, iodosuccinic acid, 3-iodo-o-toluidine, 6-iodo-m-toluidine, 2-iodo-p-toluidine, triphenylmethane iodide, α-iodo-o-xylene, 4-iodo-o-xylene, and diphenyliodonium chloride.

These compounds have been cited merely for illustrative purposes, and it should be understood that the invention is in no way limited to these compounds of the above compounds I odoacetic acid, 1,3-iodoacetone, iodofumaric acid, iodomalonic acid, triiodoacetic acid, tetraiodobenzoquinone, iodoacetamide, 2-iodobutyric acid, 2-iodocrotonic acid, 2-iodo-3-phenylacrylic acid, 2-iodopropionic acid and iodosuccinic acid are especially preferred.

The specific organic compound used in this invention can be added to the silver halide emulsion in an amount of 0.1 to 100 mol%, preferably 0.5 to 50 mol%, based on the silver halide. If the amount of the organic compound is too small, the silver halide emulsion cannot be stabilized sufficiently to light. The use of larger amounts than those specified above, however, does not increase the degree of stabilization, but brings about a deterioration in photographic properties. For example, the sensitivity is reduced.

Although the organic compound can be added at any stage during the manufacture of the silver halide emulsion, it is preferred that it be added after physical ripening but before the coating of the emulsion.

According to this invention, it is sufficient that the stabilizer be incorporated in the silver halide emulsion layer, and there is no need to use a stabilization promotor. The mere heating of the processed silver halide photographic material in the presence of the organic compound can lead to the stabilization of the photographic material to light.

The method of this invention is applicable to a very wide range of silver halide photographic materials, for example those containing silver bromide, silver chloride, silver chlorobromide, silver iodobromide, or silver chloroiodobromide.

Silver halide photographic materials containing silver halide grains at least 50 mol% of which consists of silver bromide can be stabilized to light with especially good results by heating in the presence of the stabilizer of the present invention.

The temperature of the heating for stabilization is at least 80°C., preferably at least 140°C., and the heating time is at least 1 second, preferably at least 5 seconds.

The upper limit of the heating temperature and the heating time are restricted by the destruction of the binder for the silver halide or the support as a result of heating. Generally, the higher the temperature used, the shorter is the heating time. Where the heating is at 270°C, about 60 seconds is generally, the upper limit of the heating time to prevent binder support destruction or degradation. However, where the heating is at 150°C, heating for about 15 minutes can be employed. Heating can be carried out using a hot plate, heated roller, hot air, infrared rays etc. Preferably, the heating is carried out after the formation of images, but heating can be during image formation.

If desired, the silver halide emulsion which can be used in this invention can further contain a hardening agent such as chromium alum or aldehydes, a surface active agent such as sodium laurylsulfonate, a plasticizer such as glycerol, or a sensitizing dye such as a cyanine dye or a merocyanine.

The support of the photographic material can be those conventionally used, for example, baryta paper, synthetic paperlike sheets, water-resistant papers, glass sheets, metal plates, or polymer films such as polyethylene terephthalate film or cellulose acetate films.

The following Examples illustrate the present invention in greater detail. Unless otherwise indicated, all parts and percents are by weight.

EXAMPLE 1

An aqueous solution of gelatin was stirred at 60°C., and simultaneously, an aqueous solution of silver nitrate and an aqueous solution of potassium bromide were gradually added to produce a silver bromide emulsion. The emulsion was coated on a dry plate glass in an amount of 30 mg/100 cm² calculated as silver, and dried to form a photographic material (which is designated Sample A).

Then, monoiodoacetic acid was added to the same emulsion in an amount of 5 mol% based on the silver bromide. The mixture was coated on a dry plate glass in the same amount as in the preparation of Sample A calculated as silver, and dried to form a photographic material (which is designated Sample B).

Two sheets each of Samples A and B were exposed imagewise for 5 minutes using a 20 W fluorescent lamp (illuminance 1500 lux) to form print-out images. Then, each of Sample A and Sample B was heated by contacting it for 30 seconds with an iron plate heated at 250°C. When these heated Samples A and B and the non-heated imagewise exposed Sample A and B were left to stand under a fluorescent lamp (illuminance 1800 lux), the images on the non-heated Sample A and B and the heated Sample A became obscure due to further print-out throughout these samples. On the other hand, with the heated Sample B, the densities of the colored area and the uncolored area did not change even after standing for 2 hours. When this sample was further allowed to stand in an ordinary bright room, for more than 3 weeks there was hardly any change perceptible to the eye.

EXAMPLE 2

An aqueous solution of silver nitrate, an aqueous solution of potassium bromide and an aqueous solution of potassium chloride were gradually added to an aqueous solution of gelatin being stirred at 60°C. to form a silver chlorobromide emulsion (containing 5 mol% of silver chloride). This emulsion was divided into four portions, and monoiodoacetic acid was added to each of these portions in an amount of 2.5 mol%, 5 mol%, 10 mol%, and 20 mol%, respectively. Each of the mixtures obtained was coated on a dry plate glass in an amount of 30 mg/100 cm² calculated as silver, and dried to form four samples of photographic material. When these samples were each exposed imagewise to form print-out images and then contacted for 30 seconds with an iron plate heated at 250°C., the images were stabilized.

EXAMPLE 4 to 10

Iodoacetamide was added to the same emulsion as prepared in Example 1 in an amount of 5 mol% based on the silver bromide. The mixture obtained was coated on a dry plate glass in an amount of 30 mg/100

$cm^2$ calculated as silver to form a sample of photographic material. When the sample was exposed imagewise and contacted for 30 seconds with an iron plate heated at 250°C., the image was well stabilized as in Example 1.

The above procedure was repeated using isopropyl iodide, p-iodophenol, tetraiodomethane, tert.-butyl iodide, 2-iodoethanol, and iodocyclohexane, respectively, instead of the iodoacetamide. The images on the resulting six samples were also well stabilized by heating.

EXAMPLE 11

Sample B produced in Example 1 was exposed imagewise for 5 minutes using a 20 W fluorescent lamp (illuminance 1500 lux) to form a print-out image. This sample was divided into 3 portions, and these portions were heated for 60 seconds by contact with an iron plate heated at 160°C., 180°C., and 220°C., respectively. All of these samples were stabilized to heat.

While the invention has been described in detail and with reference to specific embodiments thereof, it will be apparent to one skilled in the art that various changes and modifications can be made therein without departing from the spirit and scope thereof.

What is claimed is:

1. A method for stabilizing a silver halide photographic print out material in the dry state, which material contains an organic compound having an iodine atom connected to a carbon atom and which is capable of releasing an iodine atom or iodine ion when heated to a temperature of at least 80°C, said organic compound being a member selected from the group consisting of compounds having the following formula (I)

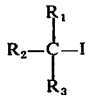

(I)

wherein each of $R_1$, $R_2$ and $R_3$ is a hydrogen atom, an alkyl group, an alkenyl group, an alkynyl group, an aryl group, a halogen atom, an acylalkoxy group, a carboxy group, a nitro group, an amino group, a substituted amino group, formyl group, an oxo group, a cyano group, or a mercapto group, said alkyl, alkenyl, alkynyl and aryl groups being either unsubstituted or substituted with a substituent selected from the group consisting of a halogen atom, a nitro group, an amino group, a formyl group, a carbonyl group, a cyano group, a mercapto group, an acyl group, and an alkoxy group, and compounds expressed by the following formula (II) I)

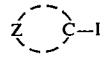

(II)

wherein Z is C, O, N, S, or Se and forms a 5- or 6-membered unsubstituted or substituted ring, said substituents being selected from the group consisting of alkyl groups, alkenyl groups, aryl groups, halogen atoms, acyl groups, alkoxy groups, aralkyl groups, carboxy groups, nitro groups, substituted amino groups, amino groups, formyl groups, carbonyl groups, cyano groups and oxo groups; said method comprising forming a print-out image on said material by exposure to actinic radiation and then heating said material to a temperature of at least 80°C.

2. The method of claim 1, wherein in the compound of the formula (I) and formula (II) at least one carbon atom adjacent the carbon atom having the iodine atom bonded thereto is a oxo group containing carbon atom.

3. The method of claim 1, wherein said organic compound is selected from the group consisting of iodine-containing paraffinic hydrocarbons, iodine-containing olefinic hydrocarbons, iodine-containing acetylenic hydrocarbons, iodine-containing aromatic hydrocarbons, iodine-containing heterocyclic hydrocarbons, iodine-containing alcohols, iodine-containing phenols, iodine-containing ethers, iodine-containing amines, iodine-containing ketones, iodine-containing aldehydes, iodine-containing carboxylic acids or the anhydrides, halides or esters thereof, iodine-containing amides, iodine-containing sulfonic acid, iodine-containing nitriles, and iodine-containing nitro compounds.

4. The method of claim 1, wherein the amount of said organic compound is 0.1 to 100 mol% based on the silver halide in said photographic material.

5. The method of claim 1, wherein the amount of said organic compound is 0.5 to 50 mol% based on the silver halide of the photographic material.

6. The method of claim 1, wherein said organic compound is added after the physical ripening of said silver halide emulsion but before the coating of said emulsion on a support.

7. The method of claim 1, wherein said heating of said photographic material is at a temperature of at least 140°C.

8. The method of claim 1, wherein said heating of said photographic material is for at least 1 second.

9. The method of claim 1, wherein said heating of said photographic material is for at least 5 seconds.

10. The method of claim 1, wherein said silver halide photographic material contains silver halide grains at least 50 mol% of which consists of silver bromide.

11. The method of claim 3, wherein said organic compound is ethyl iodide, n-butyl iodide, iodomethane, iodoform, tetraiodomethane, iodoacetic acid, 1,3-iodoacetone, α-iodoacetophenone, 1,4-iodobutane, 1,2-iodoethane, iodofumaric acid, iodomalonic acid, 1,3-iodopropane, 2,3-iodopropanol, triodoacetic acid, 1,1,1-triiodoethane, tetraiodoethylene, N-iodoacetamide, 1-iodo-2-butene, 2-iodobutyric acid 2-iodocrotonic acid, 3-iodocrotonic acid, 2-iodoethanol, 2-iodoethylamine, iodoethylene, iodogorgoic acid, 1-iodo-3-methylbutane, 2-iodo-2-methylbutane, 2-iodo-3-methylbutyric acid, iodomethyl methyl ether, tert.-butyl iodide, 2-iodo-2-methylpropionic acid, 3-iodo-3-phenylpropionic acid, 3-iodo-1-propanol, iodopropiolic acid, 2-iodopropionic acid, iodosuccinic acid, triphenylmethane iodide, or diphenyliodonium chloride.

12. The method of claim 3, wherein said organic compound is 4,6-iodo-m1phenylene diamine, 5,6-iodoquinoline, α,α'-iodo-p-xylene, 3,4,5-triiodoaniline, tetraiodobenzoquinone, tetraiodopyrrole, 4-iodobiphenyl, iodocyclohexane, 2-iodo-cyclohexanol, 2-iodoethylphenyl ether, 2-iodofuran, 2-iodo-6-nitro-1-naphthol, 4-iodo-6-nitro-1-naphthol, m-iodophenetole, o-iodophenetole, o-iodophenol, m-iodophenol, 2-iodo-3-phenylacrylic acid, 3-(m-iodophenyl) acrylic acid, 4-iodo-1-naphthylamine, 8-iodo-1-naphthylamine, 1-iodo-2-naphthylamine, 4-iodo-2-nitrobenzaldehyde, 4-iodo-m-phenylene diamine, m-iodophenyl hydrazine, 3-iodophenylphenyl ether, 4-iodopyridine, 2-iodoquinoline, 3-iodo-o-toluidine, 6-iodo-m-toluidine, 2-iodo-p-toluidine, α-iodo-o-xylene, or 4-iodo-o-xylene.

* * * * *